US007404422B2

(12) United States Patent
Kamke et al.

(10) Patent No.: US 7,404,422 B2
(45) Date of Patent: Jul. 29, 2008

(54) VISCOELASTIC THERMAL COMPRESSION OF WOOD

(75) Inventors: Frederick A. Kamke, Blacksburg, VA (US); Harrison Sizemore, III, Christiansburg, VA (US)

(73) Assignee: Eagle Analytical Company, Inc., Corvallis, OR (US)

( * ) Notice: Subject to any disclaimer, the term of this patent is extended or adjusted under 35 U.S.C. 154(b) by 513 days.

(21) Appl. No.: 10/771,511

(22) Filed: Feb. 5, 2004

(65) Prior Publication Data

US 2005/0006004 A1 Jan. 13, 2005

(51) Int. Cl.
*B27L 5/00* (2006.01)

(52) U.S. Cl. ..... 144/364; 144/380

(58) Field of Classification Search ..... 144/364, 144/380, 35, 361, 1.1, 2.1, 3.19
See application file for complete search history.

(56) References Cited

U.S. PATENT DOCUMENTS

| | | | | |
|---|---|---|---|---|
| 1,465,383 | A | 8/1923 | Walsh et al. | |
| 2,453,679 | A | 11/1948 | Stamm et al. | |
| 3,021,244 | A * | 2/1962 | Meiler | 156/62.2 |
| 4,469,156 | A | 9/1984 | Norimoto et al. | |
| 4,994,138 | A | 2/1991 | Prihoda | |
| 5,343,913 | A | 9/1994 | Tanahashi et al. | |
| 5,555,642 | A * | 9/1996 | Rem et al. | 34/423 |
| 5,596,924 | A | 1/1997 | Gerhardt | |
| 5,685,353 | A | 11/1997 | Viitaniemi et al. | |
| 5,770,319 | A | 6/1998 | Franich et al. | |
| 5,937,925 | A | 8/1999 | Lee | |
| 5,992,043 | A | 11/1999 | Guyonnet | |
| 6,083,437 | A | 7/2000 | Nishio et al. | |
| 6,235,403 | B1 * | 5/2001 | Vinden et al. | 428/537.1 |
| 6,267,920 | B1 * | 7/2001 | Arakawa et al. | 264/570 |
| 6,328,843 | B1 | 12/2001 | Bielfeldt et al. | |
| 6,344,165 | B1 | 2/2002 | Coleman | |
| 6,652,789 | B1 | 11/2003 | Pearson | |
| 6,668,713 | B2 | 12/2003 | Vomberg | |

OTHER PUBLICATIONS

Kajita et al. "Toward the new generation of bio-based composite products" Proceedings from the Third Pacific Rim Bio-Based Composites Symposium, Dec. 2-5, 1996.

Higashihara et al. "Permanent fixation of transversely compressed wood by steaming and its mechanism" 6th Pacific Rim Bio-Based Composites Symposium pp. 567-573.

Christopher M. Jennings, "Bonding Densified Wood Part 2" 1992-93 ASC/CASS Undergraduate Research Report; May 1993.

Kamke et al. "Viscoelastic Thermal Compression of Wood" 5th Pacific-Rim BioComposites Symposium; pp. 1-12 Dec. 2000.

Tomme et al. "Densified Wood: An Innovative product with highly enhanced characters" World Conference on Timber Engineering; Aug. 17-20, 1998.

(Continued)

*Primary Examiner*—Shelley Self
(74) *Attorney, Agent, or Firm*—Whitham, Curtis, Christofferson & Cook, PC

(57) ABSTRACT

A high density wood product that is made from low-density wood is provided. The wood product is made using a continuous viscoelastic thermal compression (VTC) process and exhibits high density, strength and dimensional stability, compared to the lower density starting material (typically composite panels such as strand board) from which it is made.

9 Claims, 5 Drawing Sheets

OTHER PUBLICATIONS

Rowell et al. "Treatments that enhance physical properties of wood" General Technical Report FPL-GTR-55 12 pp.

Imoue et al. "Dimensional stabilization of wood composites by steaming I. fixation of compressed wood by pre-steaming" Proceedings from the 3rd Pacific Rim Bio-Based Composites Symposium, pp. 240-248; 1996.

Seborg et al. "Heat-stabilized compressed wood (STAYPAK)" Forest Products Laboratory; No. 1580, Dec. 1962.

Christopher M. Jennings "Bonding Densified Wood" ASC/CASS Summer Undergraduate Research Report; Aug. 1992.

Inoue et al. "Steam or heat fixation of compressed wood" Wood and Fiber Science; pp. 224-235, Jul. 1993.

Hsu et al. "Chemical and physical changes required for producing dimensionally stable wood-based composites" Wood Science Technology; pp. 281-289, 1988.

Seborg et al. "Modified Woods" Forest Laboratory Library, Report No. 2192; pp. 1-30, Nov. 1962.

Elena V. Kultikova, "Structure and Properties Relationships of Densified Wood", Wood Science and Forest Products; Aug. 1999.

* cited by examiner

VISCOELASTIC THERMAL COMPRESSION OF WOOD

BACKGROUND OF THE INVENTION

1. Field of the Invention

The invention generally relates to a process for the production of high density wood from low-density wood. In particular, the invention provides a continuous viscoelastic thermal compression (VTC) process for the production of VTC wood with high density, strength and dimensional stability.

2. Background of the Invention

Wood is widely used as a material for many manufacturing endeavors, including the construction of buildings, furniture, tools, decorative objects, composites, etc. The continual utilization of virgin forests has reduced the available supply of wood from large old growth logs. Further, the "green revolution" has increased public awareness regarding the efficient utilization of timber, and protection of forest lands, particularly of old growth forests. As a result, a shift in the available resource base has occurred, from old-growth mature forests to intensively managed, short-rotation, forest plantations. Many species of trees are now grown in plantations where conditions are manipulated to encourage rapid growth of the trees. The time to harvest for a tree grown on a plantation is typically less than 20 years, compared to 50-60 or more for trees in a naturally generated forest. Unfortunately, the demand for certain types of wood products cannot be met with trees that are so rapidly grown. Although these tree "crops" are adequate for such products as paper, a high percentage of the available wood is of low density and has mechanical properties that are inadequate for structural products.

Wood with inadequate mechanical properties can be modified by various combinations of compressive, thermal and chemical treatments. It can be densified by impregnating its void volume with polymers, molten natural resins, waxes, sulfur, and even molten metals, with subsequent cooling to solidify the impregnant. On the other hand, wood can be compressed in the transverse direction under conditions that do not cause damage to the cell wall (Kollmann et al. 1975). The compression of solid wood has been done in Germany since 1930 under the trade name of Lignostone. Laminated compressed wood has been made under the trade name Lignofol. Similar materials, Jicwood and Jablo, have been in production in England for some years (Rowell and Konkol, 1987). In the United States, patents on methods of densifying wood (such as Sears, U.S. Pat. No. 646,547, Apr. 3, 1900; Walch and Watts, U.S. Pat. No. 1,465,383 Aug. 21, 1923; Olesheimer, U.S. Pat. No. 1,707,135, Mar. 26, 1929; Brossman, U.S. Pat. No. 1,834,895, Dec. 1, 1931) date back to the 1900s. These patents did not adequately consider plasticization of the wood or stabilization of the final product; for this reason, the methods described therein have not been adopted by the industry (Kollmann et al. 1975).

Another densified wood product created in the United States is Compreg (Stamm and Seborg 1941). Compreg is resin-treated compressed wood. It is normally made by treating solid wood or veneer with water-soluble phenol formaldehyde resin and compressing it to the desired specific gravity and thickness. Compreg is much more dimensionally stable than non-impregnated compressed wood. However, treating resins harden within the cell wall making the treated wood brittle. Thus, if a tough, compressed product is desired, a brittle polymer should not be impregnated in the wood. A similar resin-treated compressed wood has been made in Germany under the name of Kunstharzschichtholz (Kollmann et al. 1975).

Unfortunately, untreated, compressed solid wood and veneer tend to undergo irreversible "springback" or recovery from compression when exposed to moisture. To eliminate springback wood should be pressed under conditions that cause sufficient flow of the lignin. A second compressed wood product developed in the U.S. that is not treated with resin is Staypak (Seborg et al. 1962a). Staypak is produced by compressing wood at a moisture content equal to or below that which it will have in service. One of the problems associated with making of Staypak is that the panels must be cooled to 100° C. or less while under the full pressure. Due to the thermoplastic nature of the lignin, and because the moisture content of the wood is only slightly less after compression than prior to pressing, considerable springback will occur if the product is removed while still hot (Kollmann et al. 1975). This necessity and other disadvantages of Staypak prevented this product from being adopted by the industry.

There have been many studies relating to wood stabilization by various treatments. Hillis (1984) reviewed the literature about stabilization of wood by a heating process. The effect of steam pretreatment on wood was investigated by Hsu et. al. (1988); Inoue et al. (1993); Inoue et al. (1996) and Kawai et al. (1992). Lately, the effect of heat on the dimensional stability of compressed wood has been evaluated by Dwianto et al. (1996). Tomme et al. (1998) performed thermo-hygromechanical treatment in order to produce densified wood with stable deformation.

Dwianto et al. (1996) found that preheating had a great influence on permanent fixation. According to their results, the permanent fixation of compressive deformation in wood resulted from the release of stresses stored in microfibrils and the matrix substance of the cell wall due to their degradation.

Hsu et al. (1988) developed a steam pretreatment process to produce highly dimensionally stable wood-based composites. They found that steam pretreatment causes partial hydrolysis of hemicelluloses for both hardwoods and softwoods, which greatly increases the compressibility of wood (i.e., reduces the tendency of internal stresses to build up in composites during hot pressing).

Inoue et al. (1993) found that almost complete fixation can be achieved by post-steaming compressed wood for 1 min. at 200° C. or 8 min. at 180° C. There was a large increase in hardness and only a slight decrease in bending stiffness (MOE) and bending strength (MOR). Inoue et al. (1996) also investigated the effect of pre-steaming. They found that the degree of recovery decreases if the press time and temperature increase. Pre-steaming increases the compressibility of wood and reduces the amount of stored stress due to the viscous flow of wood substances.

Kawai et al. (1992) produced laminated veneer lumber (LVL) by steam-injection pressing. They found that MOR and MOE of compressed LVL increased with increasing density. The dimensional stability of LVL has been improved considerably. They also have proposed the mechanism responsible for the fixation of compression set by steam treatment. They hypothesize that relaxation of the stresses stored in the microfibrils and fixation of the compressive set is due to: rapid hydrolysis of hemicellulose and partial degradation of lignin; partial hydrolysis of cellulose of amorphous and paracrystalline region, and reorientation in the crystalline region by steam treatment.

Another process to enhance the strength and stiffness of low-density wood species using steam, heat and mechanical compression has been termed Viscoelastic Thermal Compression, (VTC) (Kultikova, 1999; Kamke et al., 2000; Kamke and Sizemore; 2001). However, previous descriptions of this process have been limited to batch processes which utilize constant environmental conditions to produce flat, densified materials. Thus, previous VTC procedures are not suitable for the industrial manufacture of densified wood products. In addition, previous VTC methodology dealt only with whole wood and did not address the manufacture of laminae from veneer or composite panels for use in structural laminated composites.

The prior art has thus far failed to provide an industrially applicable method for treating low density wood to produce a wood product of high density, strength, and dimensional stability. In particular, the prior art has not provided a method to produce, from veneer or composite panels, laminae of high density, strength, and dimensional stability for use in structural laminated composites.

SUMMARY OF THE INVENTION

The present invention provides a method for the production of wood products of high density, strength, and dimensional stability. The method is continuous and may be used, for example, for the production of high density laminae from lower density veneer or composite panels. The high density, dimensionally stable laminae produced by the methods of the invention are of a quality that is suitable for use in laminated composites for structural applications. High strength and stiffness wood products created according to the methods of the present invention thus provide an alternative to the use of wood from mature forests.

The present invention provides a method for densification of wood components or composite wood. The method comprises the steps of: i) heating and conditioning the wood components or composite wood to at or above a glass transition temperature of the wood; ii) inducing mechanosorption of the wood; iii) compressing the wood to form a high density wood product; iv) annealing the high density wood product; and then v) reducing the temperature of the high density wood product below its glass transition temperature. During the step of heating and conditioning, pressure in a central section of the wood component may be in a range of about 650 to about 2000 kPa, and the wood may have a moisture content of between about 15% and about 30%. The step of compressing may be performed so as to impart a profile to the high density wood product. The profile may be sinusoidal wave-like corrugations on one or both sides of the high density wood product. The step of reducing the temperature may include exposing the high density wood product to water. The step of mechanosorption may be caused by inducing rapid vapor decompression.

The invention further provides a densified wood product made by the process of i) heating and conditioning the wood to at or above a glass transition temperature of the wood; ii) inducing mechanosorption of the wood; iii) compressing the wood to form a high density wood product; iv) annealing the high density wood product; and then v) reducing the temperature of the high density wood product below its glass transition temperature. During the step of heating and conditioning, pressure in a central section of the wood may be in a range of about 650 to about 2000 kPa, and the wood may have a moisture content of between about 15% and about 30%. The step of compressing may be performed so as to impart a profile to the high density wood product. The profile may be sinusoidal wave-like corrugations on one or both sides of the high density wood product. This can be accomplished using a press plate or roller with profile imparting sections. The step of reducing the temperature may include exposing the high density wood product to water. The step of mechanosorption may be caused by inducing rapid vapor decompression.

The invention further provides an apparatus for producing a densified wood product from a low-density wood precursor, comprising i) means for simultaneously heating and conditioning; ii) means for compressing, the means for compressing being spaced apart from the means for simultaneously heating and conditioning by a desorption zone; iii) means for annealing; iv) means of spraying water; and v) means for cooling. The apparatus may further comprise a means of imparting a profile to the densified wood product.

DETAILED DESCRIPTION OF THE PREFERRED EMBODIMENTS OF THE INVENTION

Figure 1:
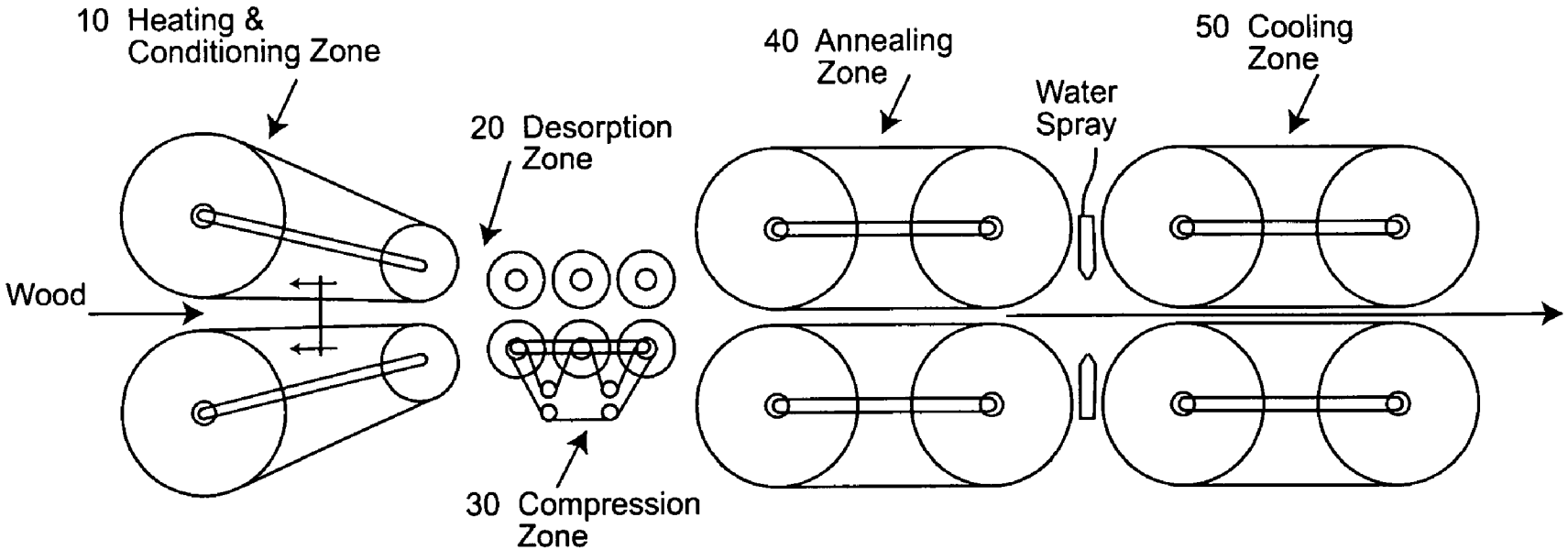
FIG. 1. Schematic view of a continuous VTC apparatus.

The present invention provides methodology for converting wood products made from low density wood (e.g. veneer and composite panels) into high density laminae with high levels of strength, stiffness, and dimensional stability. The method uses a combination of steam, heat and mechanical compression that has been termed Viscoelastic Thermal Compression (VTC), and the inventive method provides a number of improvements over prior VTC batch processing.

The term "viscoelastic" refers to a natural characteristic of the polymers that comprise the cell wall in all woody plants. Wood is made of three primary polymers, cellulose, hemicellulose, and lignin. These polymers have both viscous (ability to flow) and elastic (ability to springback) behavior. Amorphous polymers of wood (lignin and hemicelluloses), as viscoelastic materials, can behave as viscous fluids and as linear elastic solids, depending on the temperature and diluent concentration, and time of exposure to inducing conditions. For isolated amorphous polymers the transition between the glassy and the rubbery states is defined as a glass transition temperature, $T_g$ (Back and Salmen, 1982). Many properties of these polymers, such as elastic modulus, change dramatically when the material passes this "softening" point.

Heat and Moisture can be used to Manipulate the Viscoelastic Behavior.

Wood is also a porous material, being comprised of long slender cells. About one-half the volume of wood is void space, but this varies widely by species, site conditions, and rate of tree growth. The strength and stiffness of wood is directly proportional to its density. The VTC process increases the density of wood by raising the wood components to (or above) their glass transition temperature via heat and humidity, thereby softening the cell wall, and then compressing the wood components in a mechanical device.

The process involves the steps of: 1) Heating and conditioning the wood to an elevated temperature and moisture content, such that the wood substance equals or exceeds its glass transition temperature. 2) Inducing rapid vapor decompression and removal of bound water in the cell wall. This step causes a pronounced softening of the wood, which dramatically reduces the compression modulus of the wood perpendicular to the grain, and is referred to as mechanosorption. 3) Compressing the wood perpendicular to the grain while the wood is in a softened state. The glass transition temperature is maintained during compression; this step causes an increase in the density of the wood. A profiling imparting roller or plate can be used during compression. 4) Annealing the wood to allow relaxation of the remaining stresses. Annealing also promotes thermal degradation of hemicelluloses in the wood component, thereby reducing the hygroscopicity of the wood. 5) Cooling the wood to below its glass transition temperature and increasing the moisture content, i.e. the wood is equilibrated with ambient temperature and humidity.

Each of these steps is described below in reference to the zones of an apparatus designed to carry out the continuous process as depicted in FIG. 1.

Improved VTC Process Description

1. Heating and conditioning zone 10: condition the wood components to an elevated temperature and moisture content, such that the wood substance equals or exceeds its glass transition temperature without inducing cell wall fractures.

Figure 2A:
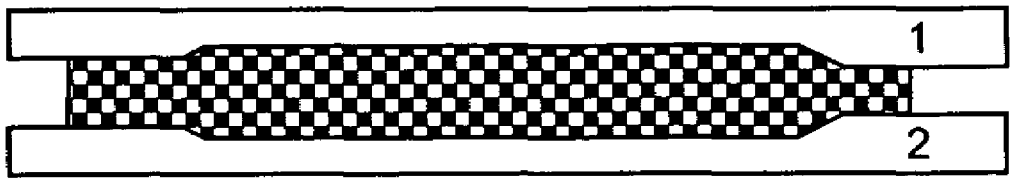
FIGS. 2A and B. A, Section view of non-uniform thickness belts in heating and conditioning zone. The non-uniform belt thickness at the edges if accentuated for clarity. 1=top belt; 2=bottom belt. B, Section view of non-uniform diameter rollers in heating and conditioning zone.
Figure 2B:
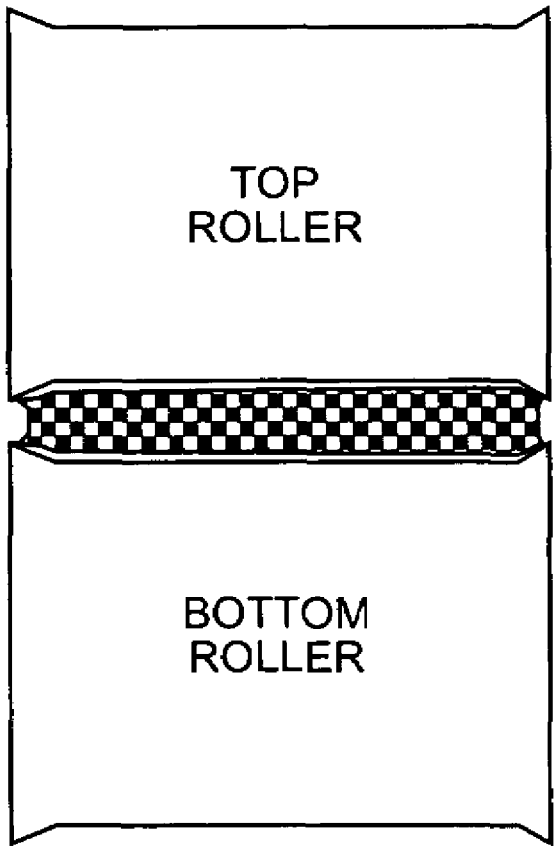

This is accomplished in the heating and conditioning zone 10. The surfaces of the wood components must be sealed from the surrounding atmosphere, which is accomplished using solid metal or polymer belts in contact with the top and bottom of the wood component (FIG. 1). It is not necessary that the seal be absolute. Some leakage may occur. However, the water vapor pressure inside the wood component must exceed the atmospheric pressure, and reach a value that will yield an equilibrium moisture content that is consistent with the glass transition temperature. The length of this zone (in the range of about 5 meters to about 10 meters) provides enough resistance to gaseous flow in the plane of the apparatus to create an effective seal. The crosswise direction (about 3 meters in width) is sealed in a similar manner, or in the case of a narrow apparatus (less than about 1 meter), a belt of non-uniform thickness (FIG. 2A), or roller of non-uniform diameter (FIG. 2B), is used to create a more dense edge, thus creating a seal.

The moisture that is needed for conditioning originates from the wood component. Wood veneer, or other wood components, that have never been dried from their natural state may be used. The moisture content may be greater than the fiber saturation point (FSP), however, about 15% to about 30% is preferred. Other processed wood components, such as a wood-strand composite (e.g. oriented strand board), is soaked in water or sprayed with water just prior to entering heating and conditioning zone 10. Wood components treated in this manner do not need to have a uniform moisture content throughout their thickness, since the heating and conditioning zone 10 will rapidly redistribute the moisture.

The mechanical pressure on the wood components is only enough to create the seal, but not enough to cause more than about 10 percent strain in the thickness direction. This pressure is preferably in the range of about 650 to about 2000 kPa in the central section of the wood component. In the case of the non-uniform belt thickness or non-uniform roller diameter, the edges will experience a higher mechanical pressure of approximately 2000 to 3,500 kPa. The original thickness of the wood component (in the range of about 3 mm to about 12 mm) will be in the range of about 5% to about 10% during this step of the procedure.

Figure 3:
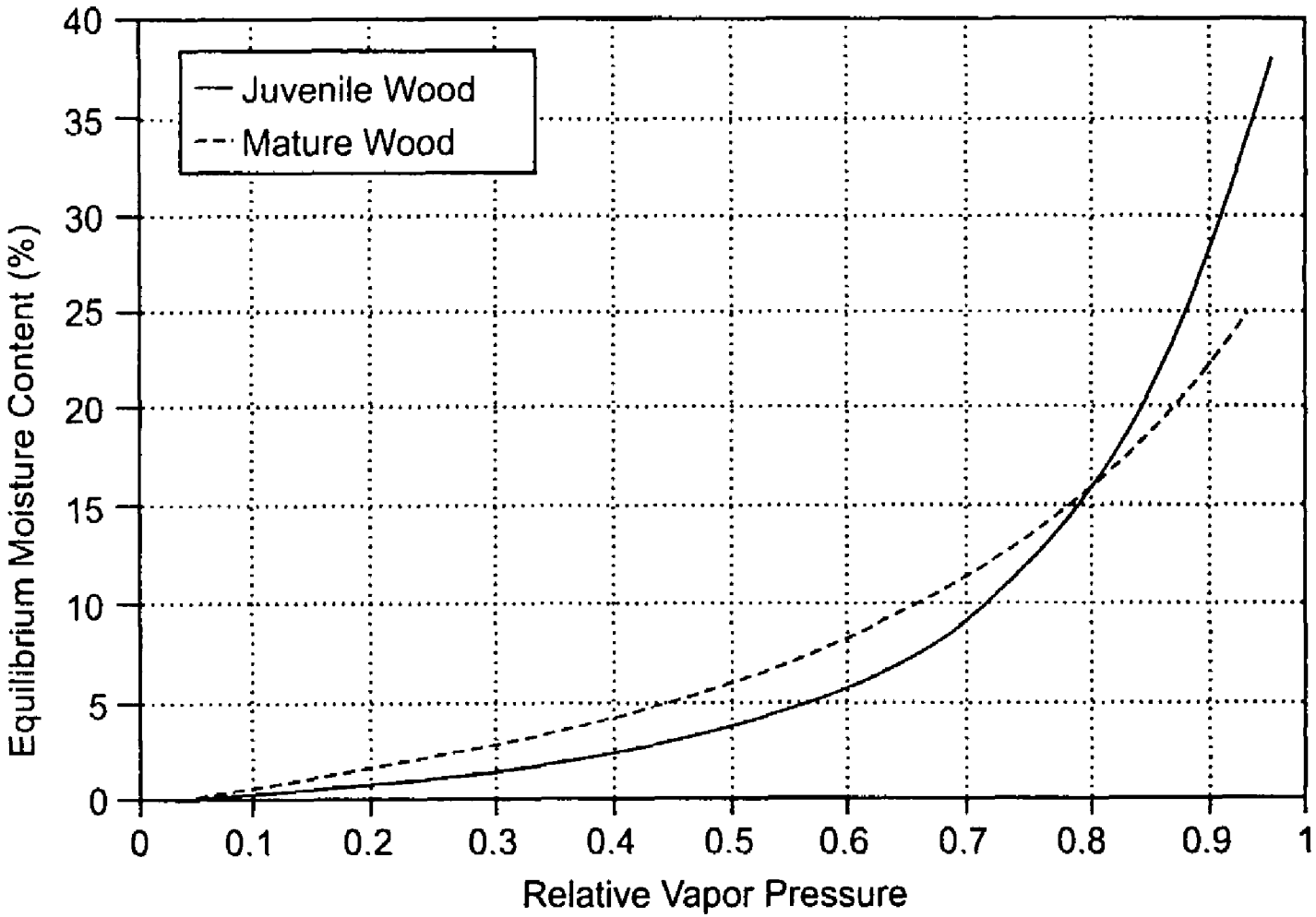
FIG. 3. Equilibrium moisture content of yellow-poplar (*Liriodendron tupilifera*) at 160° C. (Lenth and Kamke, 2001a).
Figure 4:
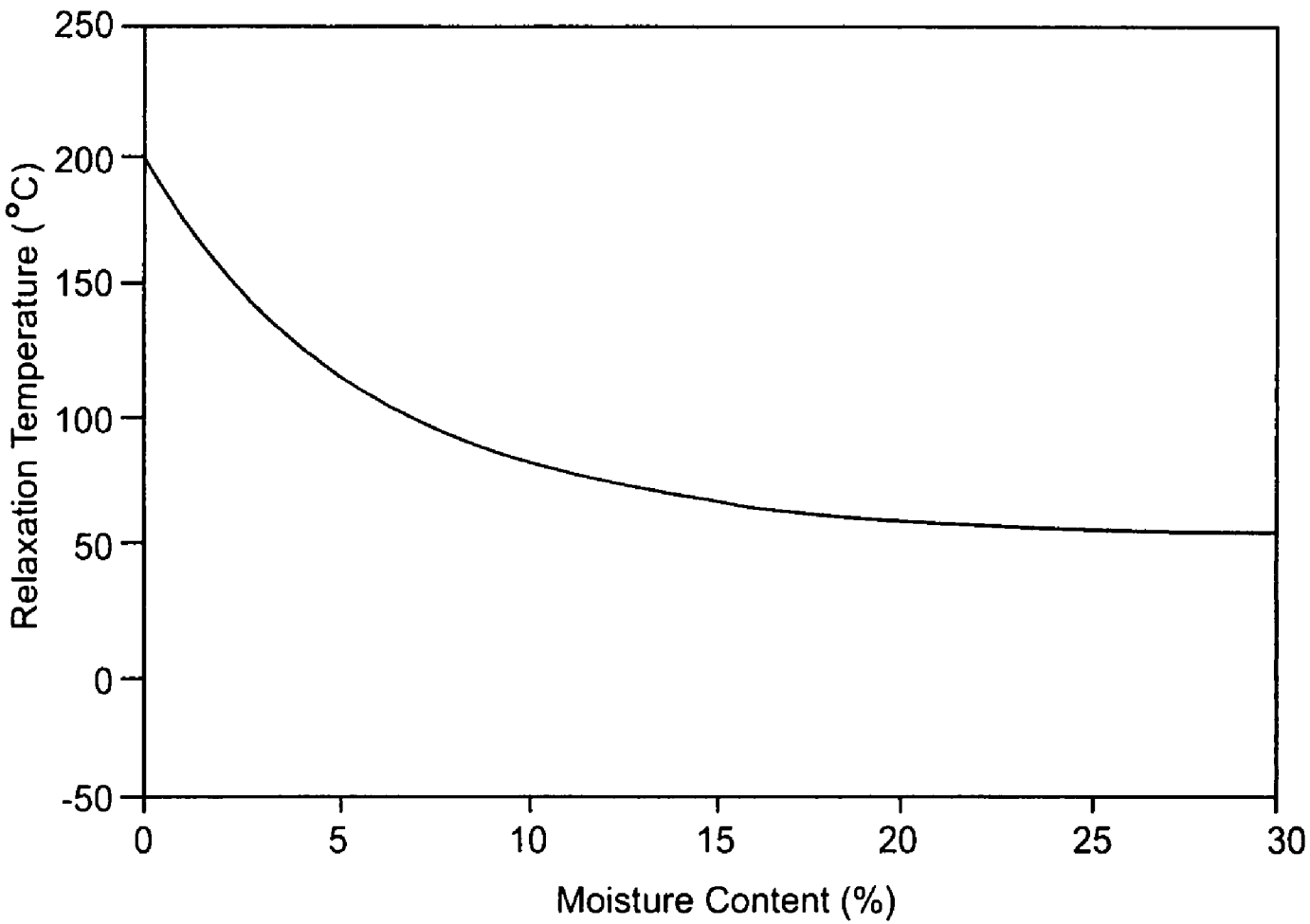
FIG. 4. Glass transition temperature of in situ lignin as a function of moisture content based on 1 Hz dynamic bending (Kelley et al., 1987).

The moisture in this zone is controlled to match the belt temperature in such a way as to meet or exceed the glass transition temperature. In addition, it is desirable to have a wood moisture content between about 15 percent and the fiber saturation point. For example, a moisture content of 20 percent and a temperature of 160° C. would be suitable for this process. As seen in FIG. 3, this condition will require a relative vapor pressure of approximately 0.85 to 0.87, which corresponds to a water vapor pressure of about 515 to 527 kPa. At 20 percent moisture content, the glass transition temperature is exceeded (FIG. 4). Although only about 2 percent moisture content is needed to match the glass transition temperature, a higher moisture content (e.g. in the range of about 15% to about 30% percent) provides a greater potential for moisture loss which will be critical in the next step of the process.

At the end of the heating and conditioning zone 10 the wood component will be pliable and yet remain free of any cell wall fractures.

2. Desorption zone 20: induce rapid vapor decompression and removal of bound water in the cell wall.

This step in the process causes a pronounced softening of the wood, which dramatically reduces the compression modulus of the wood perpendicular to the grain. This affect is called mechanosorption, and has not been exploited in the past. It occurs as a result of rapid movement of water into, or out of, the wood cell wall. In the method of the present invention, movement of water is out of the cell. The movement of moisture creates a disruption in the wood polymer structure, and retards the cells' ability to transfer stress and resist strain. In effect, the polymer molecules are able, to a greater extent, to deform under an applied load without cleaving. Under such conditions, wood may be compressed, without cell wall fracture, to a greater extent than wood at an equivalent constant moisture content. Avoidance of cell wall fracture is important because greater increases in strength and stiffness are achieved when the cell walls remain intact.

The mechanosorption phenomenon is a transient behavior. It is only effective during adsorption or desorption. Therefore, the timing of the desorption and subsequent compression is critical. Thin wood components are better suited for this process than thick ones, since thinner components will lose moisture more rapidly and uniformly. For example, the thickness of the wood components should typically be in the range of 3 mm to about 12 mm prior to compression. The time duration will vary depending on thickness and the level of vapor pressure contained in the wood from the previous step. For example, at 175° C., for materials of about 3 to about 6 mm thickness, the desorption time is about 3 to about 10 seconds, and for materials in the range of about 6 mm to about 12 mm, the desorption time is about 10 to about 100 seconds. The desorption time is roughly proportional to the thickness raised to the second power. The desorption rate is also increased with greater temperature of the wood at the time it exits the heating and conditioning zone 10. If the desorption is too rapid, the affect of the mechanosorption is not fully realized during the subsequent compression. Therefore, the desired temperature range in the heating and conditioning phase is about 160° C. to about 175° C.

3. Compression zone 30: compress the wood component perpendicular to the grain while the wood is in a softened state.

In a wood-strand or wood-wafer composite, the strands or wafers are oriented such that their thickness is aligned with the thickness of the composite. The thickness direction is perpendicular to the grain of the wood.

A series of heated rollers apply compression strain to the wood component. The number of rollers will vary depending in the thickness of the wood component and desired degree of compression, as discussed below. In one embodiment, the temperature of the rollers is set at the glass transition temperature for wood that is in equilibrium with a water vapor pressure of 101 kPa (atmospheric pressure), which is approximately 160° C. A temperature of up to about 225° C. may be used without significant thermal degradation of the wood. The same temperature range applies to all wood species. Each pair of rollers has a gap between them, through which the wood component must pass. The leading pair of rollers has a gap that is less than the gap between the belts in the heating and conditioning zone 10. Each successive pair of rollers has a progressively smaller gap, thus increasing the degree of densification. The decrease in the gap size from roller set to roller set will be approximately 5% of the initial thickness of the wood component. The number of roller pairs in this zone varies depending on the original thickness of the wood component and the desired degree of compression. Thicker components will require more roller pairs. For example, a component of about 10 mm thickness will require about 10 roller pairs to achieve 50% compression, whereas a component of about 10 mm thickness will require about 15 roller pairs to achieve about 75% compression.

A unique aspect of the compression zone 30 is the ability of the wood component to continue to lose moisture through the wide surfaces during the compression. This promotes the continuation of the mechanosorption effect.

The degree of compression achieved during this step of the process is controlled by the gap between the rollers. The maximum practical density of the densified wood is 1,500 $kg/m^3$, which is approximately the density of the cell wall substance. Since virgin wood, or a preformed wood composite (i.e. laminated strand lumber), which is the material to be processed, will vary in density, the maximum strain possible will also vary. Low density wood can be subjected to a higher maximum strain than a high density wood. For example, wood with a starting density of 300 $kg/m^3$ could be compressed to about 20 percent of it original thickness. However, wood with a starting density of 750 $kg/m^3$ could only be compressed to about 50 percent of its original thickness. However, those of skill in the art will recognize that there may be applications for which it is unnecessary to achieve maximal densification of the wood component. For example, it may be sufficient or desirable to achieve densification of from about 10 to about 100%, from about 25 to about 100%, from about 50 to about 100%, or from about 75 to about 100% of the maximum possible densification.

Figure 5A:
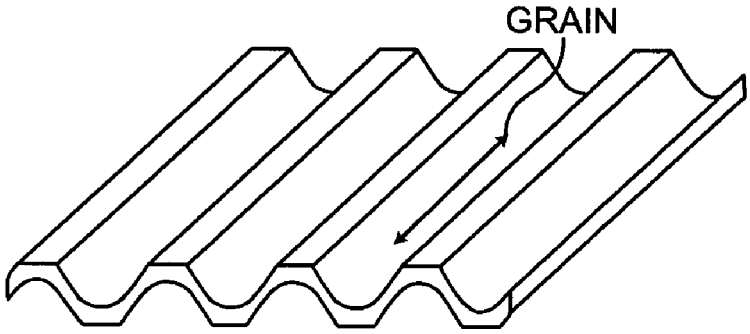
FIG. 5A-C. A, illustration of a VTC wood laminae with unidirectional corrugation and uniform density; B, illustration of a VTC wood laminae with unidirectional corrugation and non-uniform density; C, illustration of a layered composite consisting of two layers of unidirectional corrugated VTC wood and a core comprised of another wood-based material.
Figure 5B:
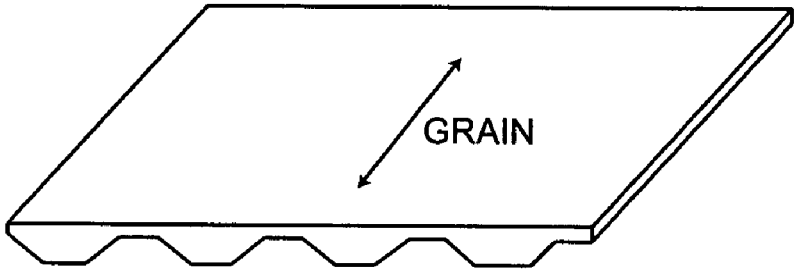
Figure 5C:
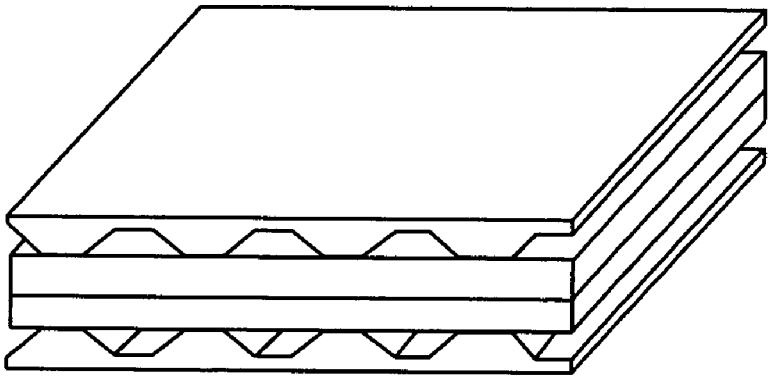

A variation of the compression zone 30 is to impart a profile into the wood component. The profile may appear as sinusoidal wave-like corrugations across the width and oriented parallel to the grain (FIG. 5A). This profile will yield a VTC wood component that has a uniform density. Another variation is shown in FIG. 5B. This VTC wood component will have a non-uniform density and one flat surface. The pattern is caused by the rollers, which are machined to create the desired embossed effect. One purpose of the profiling is to create "gaps" in the lamina so that when later assembled into a laminated composite, the composite will have a lower overall density due to the void spaces created by the gaps (FIG. 5C). However, the improved strength and stiffness would still largely be retained. In addition, the corrugation will permit a larger effective section modulus than a flat VTC wood component with the same mass of wood. One of skill in the art will recognize that the desirable number and size of the gaps/corrugations may vary from application to application, depending, for example, on the desired density of the final laminated composite. Generally, however, the spacing of the corrugations will be in the range of about 3 to 6 times the thickness from center to center. The depth of the corrugation will be about 1 to about 3 times the thickness of the thinnest section of the corrugated component (FIG. 5B). The thinnest section corresponds to the highest density in the non-uniform corrugated VTC component.

Alternatively, other patterns such as grooves or channels or any desired shape, decorative designs, etc. may be introduced onto the compressed wood for purposes including but not limited to: in order to facilitate interlocking multiple layers of compressed laminae to form a multilayered wood product; to form a design on the surface of the high density wood product, to provide a channel for threading, inserting or circulating other components between laminae layers in a multilayered wood product (e.g. metal strips, wiring, heating elements, glue or resins, etc.).

At the completion of this step in the process the wood component will have been increased in density and further reduced in moisture content. It will still be at or above the glass transition temperature. Some elasticity will remain, which would result in thickness recovery if there is no mechanical restraint.

4. Annealing zone 40: relax the remaining stresses and reduce the hygroscopicity of the wood. The remaining stresses in the wood are due to stretched polymer molecules within the cell wall. These polymers include the lignin, hemicelluloses, and amorphous regions of the cellulose. The molecules are restrained by entanglements of the backbone carbon chain and/or entanglements of side-groups on the molecule. With time and increased molecular motions, the polymer molecules will slip into a more relaxed conformation. Increasing the temperature will increase molecular motion and assist stress relaxation. The annealing zone 40 consists of two traveling belt systems, similar to a conventional continuous press used for composite panel manufacture. The temperature is set at about 175° C. to about 225° C., and the compressed wood is held under mechanical pressure at a maximum level of approximately 2000 to 4000 kPa. The level of force depends on the degree of compression that was achieved in the previous step. More compression will require a higher restraining force in this step. The control is based on distance between the belts. The mechanical force needed will decline as stress is relaxed. Therefore, at the end of the annealing zone 40 the force required to control the thickness will be near zero. The purpose of annealing the compressed wood is to relax stress and promote thermal degradation of hemicelluloses in the wood component. Stress relaxation depends on time, temperature, and moisture content. Since the moisture content at this point is low, perhaps 2 percent, only temperature and time are controlled. The time of annealing depends on the feed rate of the wood component and the length of this press section, and will generally be in the range of from about 60 to about 120 seconds.

Thermal degradation is primarily the result of certain hemicellulose polymers breaking down. It is believed that the backbone of the polymer chain is cleaved, resulting in free radicals, and further reactions. Some of the compounds are volatile. Example degradation products are furfural, furan, and acetic acid. Some crosslinking of the remaining polymers may also occur. Many hydroxyl sites will be lost, and consequently, the ability of the wood to adsorb moisture (i.e. hydroscopicity) is reduced, resulting in improved dimensional stability of the compressed wood component upon exposure to moisture during use.

At the end of this zone the wood component will be compressed to the desired degree of strain, moisture content will be almost zero, stress will be low, and the hygroscopicity will be low.

5. Cooling zone 50: reduce the temperature of the wood component below its glass transition temperature and increase the moisture content.

Entering this zone the wood component is sprayed with water, which serves two purposes. First, the rapid evaporation will consume heat energy and reduce the temperature of the wood. Second, some of the water will be adsorbed, although not much due to the annealing process. The goal is to achieve a moisture content that will be in equilibrium with the surrounding environment at the completion of the process. Sprayed water is applied to the wood continuously as it leaves the last annealing zone roller until it enters the first cooling zone roller, a distance of about 1 meter.

The main section of the cooling zone 50 is another twin belt continuous press. No heating is used, and cooling is accomplished through heat exchange with the surrounding environment. The length of this zone again depends on the thickness of the wood component. In general, for a wood component of in the range of about 4 mm in thickness, the length of the zone will be in the range of about 3 meters. Mechanical pressure is applied and should be sufficient to maintain thickness at the same level as at the exit from the annealing zone.

The temperature of the wood component must be reduced to below the glass transition temperature before the restraining force is released. This will insure that the component remains flat and minimizes the amount of thickness recovery. Thus, the length of the cooling zone 50 must be sufficient to allow, together with cooling due to water spray, a decrease in temperature of the wood component as it travels along the belt to below its glass temperature. Further, the cooling process also facilitates handling of the finished compressed wood product by reducing the temperature to at or approaching ambient room temperature. Typically, the length of the belt required to accomplish sufficient cooling (i.e. cooling to a temperature in the range of about 30° C. to about 50° C.) may be in the range of about 3 to about 6 meters.

At the completion of the cooling zone 50, the improved VTC process is complete. The result will be a densified laminate with increased strength and stiffness, as well as a reduced affinity for water.

The present invention provides methods for increasing the density of wood, in particular of wood products such as veneers and composites (e.g. oriented strand board, etc.). Those of skill in the art will recognize that such wood products are made from a variety of types of wood, and that the wood components of those products will have densities that vary from product to product, from one batch of product to another, and even within a single product. The methods of the present invention can be used, in general, to increase the overall or average density of any such product. The amount of such an increase will depend on several factors which include but are not limited to: the initial density of the product being treated, which in turn may depend on the type and growth history of the wood; the thickness of the product being treated; the form of the wood in the product (e.g. size and shape of wood elements); previous treatments of the wood product such as pressure and/or heat treatment, infusion with resin, etc.; and the desired final density. In general, increases in density achieved by the methods of the present invention will be in the range of about 25% to about 500%, and preferably in the range of about 100% to about 200%.

The present invention provides methods for increasing the density of wood, and in particular of wood products, examples of which include but are not limited to: veneers; sawn wood; composites such as strand board, wafer board; scrim board, etc.

The final product of the method of the present invention is a densified wood product in the form of, for example a sheet or panel. The densified wood product is made by the process of i) heating and conditioning wood components or composite wood to at or above a glass transition temperature of the wood; ii) inducing mechanosorption of the wood; iii) compressing the wood to form a high density wood product; iv) annealing the high density wood product; and then v) reducing the temperature of the high density wood product below its glass transition temperature.

Those of skill in the art will recognize that the resulting product may be further processed in any of many ways for further use, including but not limited to: cutting and shaping the sheets or panels into various desired lengths or shapes; attaching multiple layers of the sheets together with like material or other materials to form a multilayered laminate material of a desired thickness; "cosmetic" processing such as coloring, staining, etching, overlaying, etc.

The end-use of the densified wood products of the present invention, in whole or as a composite, include but are not limited to: various building materials such as structural components (e.g. beams, joists, studs, etc.); flooring and underlayment materials; siding and roofing material; materials for constructing walls (e.g. in place of wall board, or as paneling, wainscoting, trim, etc.); furniture manufacture; material for fences; pallets; shipping containers; etc. Due to the low hydroscopcity of the products, they may be used for both inside and outside applications.

The present invention also provides an apparatus for carrying out the methods of the present invention, e.g. for producing a densified wood product from a low- (or lower-) density wood precursor. With reference to FIG. 1, the apparatus includes a means for simultaneously heating and conditioning; a means for compressing that is spaced apart from the means for simultaneously heating and conditioning by a desorption zone 20; a means for annealing; a means for spraying water; and a means for cooling. The means for initially conditioning the wood to be densified by simultaneously heating and conditioning will typically employ solid metal or polymer belts that contact the top and bottom of the wood as depicted in FIG. 1, and as described in section 1 of "VTC Process Description" above. A means for compression of the wood component to a desired thickness is also part of the apparatus, and is spaced apart from the heating/conditioning means by a zone in which desorption occurs. This zone may be a "space" physically located between the heating/conditioning means and the means of compression through which the wood component (which has been heated and conditioned) passes prior to entering the compression means. The compression means comprises, for example, a series of heated rollers. The temperature of the rollers is set at the glass transition temperature of the wood component. The rollers may include means of imparting a profile to the wood component during compression. The apparatus further includes an annealing zone 40 which comprises two traveling belt systems that hold the now-compressed wood product at a temperature of about 175 to about 225° C., and at a mechanical pressure of about 2000 to about 4000 kPa. Finally, upon leaving the annealing zone 40, the compressed wood product encounters a spray of cooling water and enters a cooling zone 50. The cooling zone is a twin belt continuous press that is not heated, but in which a restraining force is still applied until the wood product has been cooled to at or near ambient temperature.

Those of skill in the art will recognize that there are numerous designs for constructing a apparatus of this type, for example, for the exact placement, size and composition of the belts; for controlling the rate of movement of the belts; for monitoring the temperatures and pressures at various points along the apparatus, etc. See, for example, the descriptions of various continuous press apparatuses that were designed for the consolidation of particulate mats and veneer mats (Prihoda, U.S. Pat. No. 4,994,138, Feb. 19, 1991; Gerhardt, U.S. Pat. No. 5,596,924, Jan. 28, 1997; Biefeldt and Graf, U.S. Pat. No. 6,328,843, Dec. 11, 2001; Pearson, U.S. Pat. No. 6,652,789, Nov. 25, 2003), each of which we herein incorporate by reference. Any such suitable design may be utilized in the apparatus of the present invention. What is necessary is that the apparatus be able to carry out the various steps of the method of the invention in a manner that results in the production of a high density wood product as described herein.

EXAMPLES

Example 1

Treatment of Yellow-poplar Veneer with the VTC Process

Yellow-poplar (*Liriodendron tulipifera*) veneer, 8.4 mm thick, with a moisture content of 10% and a specific gravity of 0.42, was treated with the VTC process. With the addition of water, the heating and conditioning phase was set at 170° C. and 772 kPa steam pressure. At this pressurized condition the wood quickly adsorbed moisture to approximately 20%. Compression pressure was ramped up to 4000 kPa and held for 180 seconds. Rapid decompression to 100 kPa followed, which coincided with the release of the compaction pressure. The wood rapidly lost moisture over a 10 second interval, and was continuing to loose moisture, when the compaction pressure was again applied, to a level as needed, until a thickness of 1.8 mm was achieved. The compression was held for 3 minutes at 170° C. A cooling phase followed, at a compaction pressure of 4000 kPa, until the temperature of the specimen dropped below 50° C. The final thickness was 1.9 mm. The VTC yellow-poplar veneer was formed into a 3-layer, laminated composite, with the VTC wood in the two outer layers and a strip of untreated yellow-poplar in the core layer. The laminated VTC composite was then tested in bending. The modulus of elasticity and modulus of rupture of the VTC composite increased by 130% and 91%, respectively, compared to a matched composite sample that was made from untreated veneer.

Example 2

Treatment of Oriented Strand Composite with the VTC Process

An oriented strand composite, made from loblolly pine (*Pinus taeda*) and phenol-formaldehyde adhesive, was used for this test. The initial specific gravity was 0.64, with a moisture content of 10% and thickness of 9.7 mm. The same VTC treatment was applied as described in Example 1. The thickness was reduced to 8.6 mm and the specific gravity increased to 0.72. The VTC strand composite was then tested in bending. The modulus of elasticity and modulus of rupture of the VTC composite increased by 134% and 260%, respectively, compared to the untreated composite sample.

TABLE 1

Bending stiffness and strength of composites described in Examples 1 and 2.

| Specimen | MOE ($10^7$ kPa) | MOE ($10^6$ psi) | MOR ($10^5$ kPa) | MOR ($10^4$ psi) |
|---|---|---|---|---|
| Yellow-poplar control | 1.17 | 1.70 | 1.18 | 1.71 |
| Loblolly pine strand composite control | 0.512 | 0.743 | 0.267 | 0.386 |
| Yellow-poplar VTC laminated composite | 2.70 | 3.92 | 2.25 | 3.27 |
| Loblolly pine VTC strand composite | 1.20 | 1.74 | 0.958 | 1.39 |

While the invention has been described in terms of its preferred embodiments, those skilled in the art will recognize that the invention can be practiced with modification within the spirit and scope of the appended claims. Accordingly, the present invention should not be limited to the embodiments as described above, but should further include all modifications and equivalents thereof within the spirit and scope of the description provided herein.

REFERENCES

Back, E. L. N. L. Salmen. 1982. *Tappi Journal*, 65(7): 107-110.

Bielfeldt, F. B. and M. Graf. Method for producing boards made of wood-based materials and synthetic boards in a continuous operating press. U.S. Pat. No. 6,328,843 B1 (Dec. 11, 2001).

Brossman, J. R. U.S. Pat. No. 1,834,895 (Dec. 1, 1931).

Dwianto, W., M. Inoue, F. Tanaka, M. Norimoto. 1996. The permanent fixation of compressive deformation in wood by heat treatment. In Proceedings from the Third Pacific Rim Bio-Based Composites Symposium, Kyoto, Japan. pp. 231-239.

Gerhardt, K. Belt press for continuous manufacture of wood-product members. U.S. Pat. No. 5,596,924 (Jan. 28, 1997).

Hillis, W. E., A. N. Rozsa. 1978. The softening temperatures of wood. Holzforschung, 32, H.2: 68-73.

Hsu, W. E., W. Schwald, J. Schwald, J. A. Shields 1988. Chemical and physical changes required for producing dimensionally stable wood-based composites. Part I: Steam pretreatment. Wood Science and Technology, 22: 281-289.

Inoue, M., N. Sekino, T. Morooka, M. Norimoto. 1996. Dimensional stabilization of wood composites by steaming I. Fixation of compressed wood by pre-steaming. In Proceedings from the Third Pacific Rim Bio-Based Composites Symposium, Kyoto, Japan. pp. 240-248.

Inoue, M., M. Norimoto, M. Tanahashi, R. M. Rowell 1993. Steam or heat fixation of compressed wood. Wood and Fiber Science, 25(3): 224-235.

Kamke, F. A. and H. Sizemore III. 2001. Method for producing high strength and high modulus laminates from wood. Confidential report. Sustainable Engineered Materials Institute, Virginia Polytechnic Institute and State University, Blacksburg, Va.

Kamke, F. A. ; E. V. Kultikova; and C. A. Lenth. 2000. Viscoelastic thermal compression of wood. In: Proc. 5$^{th}$ Pacific Rim Bio-Based Composites Symp., Dec. 10-13, 2000, Canberra, Australia. Ed. P. Evans, Dept. Forestry, Australian National University, Canberra, Australia, p. 292-302.

Kawai, S., Q. Wang, H. Sasaki, M. Tanahashi. 1992. Production of compressed laminated veneer lumber by steam pressing. In Proceedings of the Pacific Rim Bio-Based Composites Symposium, p. 121-128.

Kelly, S. S. T. G. Rials, and W. G. Glasser. 1987. Relaxation behavior of the amorphous components of wood. J. Mat. Sci. 22:617-624.

Kollmann, F. P., E. W. Kuenzi, A. J. Stamm. 1975. Principles of wood science and technology. Vol. II Wood based materials. Springer-Verlag New York Heidelberg Berlin. pp. 139-149.

Kultikova, E. 1999. Material property evaluation of densified wood. M. S. Thesis. Virginia Polytechnic Institute and State University, Blacksburg, Va.

Lenth, C. A. and F. A. Kamke. 2001. Equilibrium moisture content of wood in high-temperature pressurized environments. Wood and Fiber Sci. 33(1):104-118.

Lenth, C. A. and F. A. Kamke. 2001. Moisture dependent softening behavior of wood. Wood and Fiber Sci. 33(3): 492-507.

Olesheimer, L. J. U.S. Pat. No. 1,707,135 (Mar. 26, 1929).

Pearson, M. T. Composite veneer. U.S. Pat. No. 6,652,789 (Nov. 25, 2003).

Prihoda, P. J. Press for wood composites. U.S. Pat. No. 4,994, 138 (Feb. 19, 1991).

Rowell, R. M., P. Konkol. 1987. Treatments that enhance physical properties of wood. FPL, General Technical Report FPL-GTR-55, 12 pp.

Sears, C. U. U.S. Pat. No. 646,547 (Apr. 3, 1900).

Seborg, R. M., M. A. Millett, A. J. Stamm. 1962. Heat-stabilized compressed wood (Staypak). FPL, Report No. 1580 (revised), 22 pp.

Stamm, A. J., R. M. Seborg. 1941. Resin treated, laminated, compressed wood. Trans. Am. Inst. Chem. Eng., 37:385-397.

Tomme, F., F. Girardet, B. Gfeller, P. Navi. 1998. Densified wood: an innovative product with highly enhanced characters. World Conference on Timber Engineering, Switzerland.

Walch, F. J. and R. L. Watts. U.S. Pat. No. 1,465,383 (Aug. 21, 1923).

We claim:

1. A method for densification of wood components or composite wood, comprising the steps of:

i) heating and conditioning said wood components or composite wood to at least a glass transition temperature of said wood components or composite wood, then ii) inducing mechanosorption of said wood components or composite wood, then iii) compressing said wood components or composite wood to form a high density wood product, then iv) annealing said high density wood product, and then v) reducing the temperature of said high density wood product below said glass transition temperature.

2. The method of claim 1 wherein said step of heating and conditioning is performed so as to produce a pressure in a central section of said wood components or composite wood in a range of 650 to 2000 kPa.

3. The method of claim 1 wherein said step of heating and conditioning is performed so as to produce a moisture content of said wood components or composite wood ranging from 15% to 30%.

4. The method of claim 1, wherein said step of compressing is performed so as to impart a profile to said high density wood product.

5. The method of claim 4 wherein said profile is sinusoidal wave corrugations.

6. The method of claim 1 wherein said step of compressing is performed so as to impart a profile to one side of said high density wood product.

7. The method of claim 1 wherein said step of compressing is performed so as to impart a profile on opposite sides of said high density wood product.

8. The method of claim 1 wherein said step of inducing mechanosorption is performed by inducing rapid vapor decompression.

9. The method of claim 1, wherein said step of reducing the temperature includes exposing said high density wood product to water.

* * * * *